United States Patent [19]

Taylor et al.

[11] Patent Number: 4,735,055

[45] Date of Patent: Apr. 5, 1988

[54] METHOD OF OPERATING A TRANSPORT REFRIGERATION SYSTEM HAVING A SIX CYLINDER COMPRESSOR

[75] Inventors: David H. Taylor, Bloomington; Lee J. Erickson, Eagan; Leland L. Howland, Belle Plaine, all of Minn.

[73] Assignee: Thermo King Corporation, Minneapolis, Minn.

[21] Appl. No.: 61,765

[22] Filed: Jun. 15, 1987

[51] Int. Cl.[4] ..... F25B 49/00

[52] U.S. Cl. ..... 62/115; 62/175; 62/196.2; 62/228.4; 62/228.5; 236/1 EA

[58] Field of Search ..... 62/160, 159, 196.1, 62/196.2, 196.3, 228.3, 228.4, 228.5, 324.1, 324.6, 229, 158, 157, 231, 115, 215, 175; 236/1 EA; 165/26

[56] References Cited

U.S. PATENT DOCUMENTS

| | | | |
|---|---|---|---|
| 3,500,898 | 3/1970 | Gerhart, Jr. et al. | 165/26 |
| 4,228,846 | 10/1980 | Smorol | 62/228.2 |
| 4,325,224 | 4/1982 | Howland | 62/196.2 |
| 4,327,558 | 5/1982 | Howland et al. | 62/160 |
| 4,353,221 | 10/1982 | Taylor | 62/239 |
| 4,356,961 | 11/1982 | Smith | 236/1 EA |
| 4,384,462 | 5/1983 | Overman et al. | 62/175 |
| 4,485,634 | 12/1984 | Yasuda et al. | 62/229 X |

*Primary Examiner*—Harry B. Tanner
*Attorney, Agent, or Firm*—D. R. Lackey

[57] ABSTRACT

A method of operating a transport refrigeration system having a six cylinder compressor and a prime mover operable at a selected one of low and high speeds, to control the temperature of a served space by cooling and hot gas heating modes. Below a set point temperature 100, system heating capacity is controlled at the low compressor speed by the step 127 of unloading compressor cylinders and the step 129 of reloading compressor cylinders. A temperature rise of the served space above a set point temperature 106 controls cooling capacity by a combination of alternative steps 135, 137, 139, 141, and 143 which may or may not change the number of loaded compressor cylinders, and may or may not change compressor speed, based upon two predetermined trigger events which relate to what the temperature of the served space does relative to time 136 and 142, a set point temperature 106, and a temperature 108 above set point which is normally associated with a change in compressor speed.

7 Claims, 3 Drawing Sheets

METHOD OF OPERATING A TRANSPORT REFRIGERATION SYSTEM HAVING A SIX CYLINDER COMPRESSOR

TECHNICAL FIELD

The invention relates in general to transport refrigeration systems, such as for trailers, trucks, and containers, and more specifically to a new and improved method of operating a transport refrigeration system having a six cylinder compressor.

BACKGROUND ART

Prior art transport refrigeration systems commonly control the temperature of a served space by cooling and hot gas heating modes above and below a predetermined set point temperature, respectively. A high speed relay is operable at predetermined temperatures above and below set point, for controlling when the compressor speed is changed between two values which are commonly called high speed and low speed.

During the cooling mode, the output of the compressor is directed via an appropriate valve arrangement, such as a three-way valve, or two separate valves, through a refrigeration circuit which includes a condenser, receiver, expansion valve, evaporator, and usually an accumulator. During a heating mode, which includes heating cycles for controlling set point, as well as heating cycles for defrost purposes, the hot gas output of the compressor is directed via the valve arrangement through a refrigeration circuit which includes only the evaporator and accumulator. The load on the prime mover reflects evaporator pressure during the cooling mode, and it reflects compressor gas discharge pressure during the heating mode. The expansion valve, which limits suction pressure during a cooling mode, is by-passed during a heating mode, and is thus not available for limiting suction pressure. A suction pressure throttling valve, also called a crankcase pressure regulator, is usually provided in the suction line to regulate the amount of refrigerant returning to the compressor, which in turn limits the suction pressure and the load on the prime mover during the heating mode of the system.

The throttling valve has the disadvantage of always being in an active refrigeration circuit, including during the cooling mode when higher compressor discharge pressures can be tolerated without overloading the prime mover. The pressure reduction caused by the throttling valve during a cooling mode thus limits cooling capacity, and it adds significant cost to the system. Also, throttle valves having a rating suitable for use with large capacity six cylinder compressors provide an unusually high and thus undesirable pressure drop. Providing a high pressure cutout device responsive to head pressure to terminate a heating mode could be used instead of a suction pressure throttling valve, but it causes needless cycling of the system between modes.

The high speed cooling and high speed heating modes of prior art transport refrigeration systems are normally required for the purposes of: (a) providing a fast temperature pull-down in the served space upon initial start-up of the system, (b) increasing heating capacity to prevent freezing of a perishable load in the event of low ambient temperatures, and (c) for providing a fast defrost cycle. High speed operation increases fuel consumption and load on the prime mover, however, and should be avoided in order to increase system efficiency, unless there is no viable alternative.

Thus, it would be desirable to provide a new and improved method of operating a transport refrigeration system having a six cylinder compressor which provides maximum cooling capacity without the danger of overloading the compressor and prime mover during a heating or defrost cycle, which limits prime mover horsepower by always operating with the fewest possible number of loaded compressor cylinders in any given heating or cooling mode, and which limits the amount of time the system spends at high speed.

DISCLOSURE OF THE INVENTION

Briefly, the present invention in a new and improved method of operating a transport refrigeration system having a six cylinder compressor which is operable at a selected one of high and low speeds, and which has selectively loadable cylinders in three steps such that the six cylinder capacity may be successively reduced to four and two cylinders, and vice versa. The new and improved method reduces the amount of operating time that the system will spend in high speed operation by eliminating the high speed option from the heating and defrost modes. Heating capacity is controlled entirely by loading and unloading compressor cylinders. The amount of high speed operating time is reduced during a cooling mode, without hampering system effectiveness, by delaying shift to high speed under certain operating conditions; and, when high speed operation is found to be necessary, by always linking high speed with the maximum six cylinder cooling capacity, to quickly reduce temperature of the served space to the point where the system will switch to low speed operation.

More specifically, the new and improved method operates at full six cylinder cooling capacity and at high speed upon initial temperature pull-down of the served space, until the served space reaches a predetermined temperature differential above the set point. A high speed relay then drops out to initiate low speed operation and an unloading solenoid picks up to reduce cooling capacity by unloading two compressor cylinders. If the temperature drops below the set point, a heat relay picks up to initiate a heating mode and a second unloading solenoid picks up to reduce capacity still further by unloading two more compressor cylinders. If the temperature should continue to drop, indicating inadequate heating capacity, one of the unloading solenoids drops out at a predetermined temperature differential below set point, to load two additional compressor cylinders. Four cylinder operation at low speed will provide adequate heating capacity even under the most severe ambient conditions, as well as an efficient and fast defrost cycle. Thus, neither high speed operation nor full compressor capacity are utilized during a heating or a defrost cycle.

At the time the temperature of the served space drops below set point, a dump valve solenoid is enabled, and it remains enabled until the temperature of the served space rises above the set point. If the compressor head pressure should exceed a predetermined value while the dump valve solenoid is enabled, i.e., during a heating or defrost cycle, the dump valve solenoid operates to open a valve and dump hot compressor gas into the condenser. Thus, head pressure is reduced, as well as load on the prime mover, without the necessity of utilizing a costly suction throttle valve which also has the disadvantage of deleteriously affecting operation during a cooling mode.

When the temperature of the served space rises during the four cylinder heating mode, the four cylinder low speed heating mode gives way to a two cylinder low speed heating mode. If the temperature continues to rise and the set point temperature is exceeded, the system changes to a cooling mode while retaining low speed, two cylinder operation. Simultaneous with the shift from heating mode to cooling mode a timer is activated. If the temperature of the served space drops back below the set point before reaching the high speed switching point, and before the timer times out, the system merely switches back to a heating mode, still retaining low speed, two cylinder operation. Timing out of the timer, or reaching the high speed temperature differential point, whichever comes first, prior to driving the temperature back to set point, will increase cooling capacity by loading two additional compressor cylinders. High speed operation is enabled only after one of these two trigger conditions has occurred. If the temperature is reduced to set point before the remaining trigger condition occurs, the system will not switch to high speed. If the remaining trigger condition does occur while the temperature of the served space is above set point, then two additional compressor cylinders are loaded, to bring the number to six, and the high speed solenoid is actuated to switch the prime mover to high speed.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
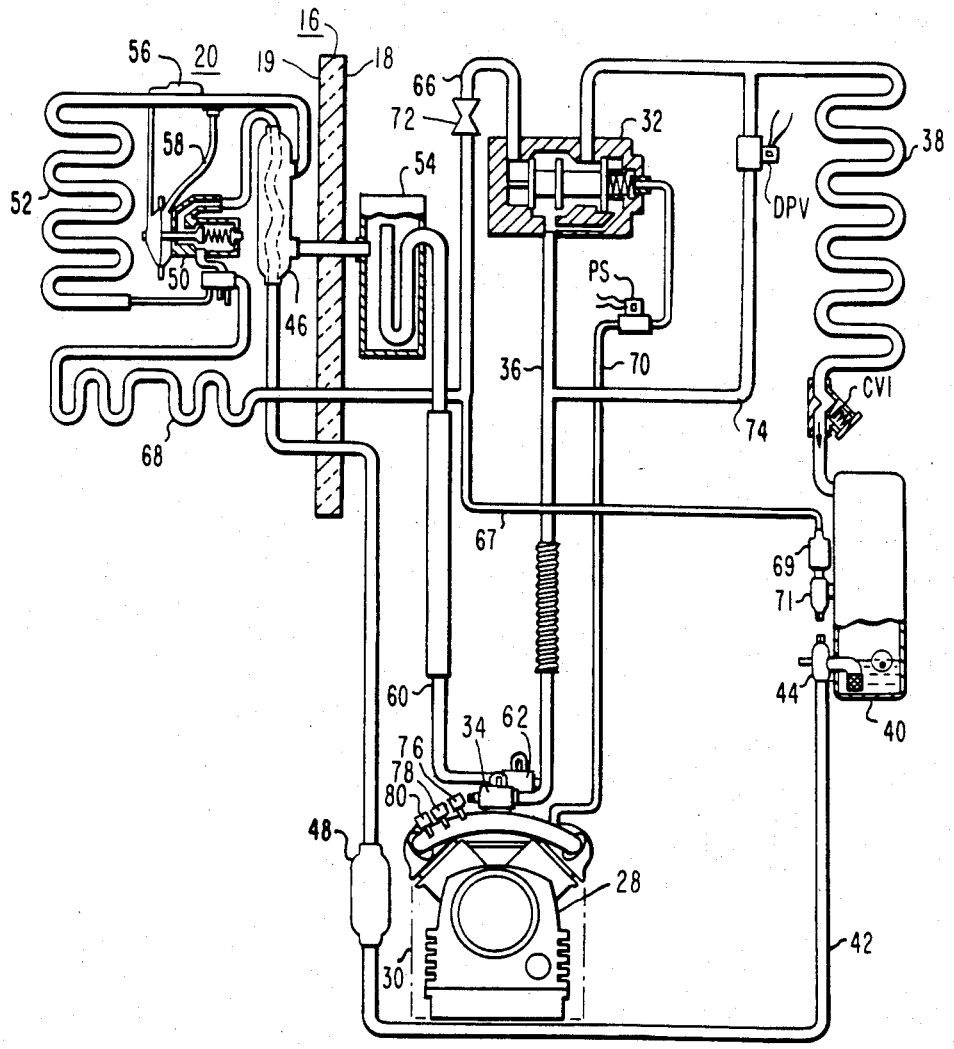
FIG. 1 is a schematic piping diagram of a transport refrigeration system constructed and arranged to practice the new and improved method of the invention.

Referring now to the drawings, and to FIG. 1 in particular, there is shown a schematic piping diagram of a transport refrigeration system 14 which may be used to practice the new and improved methods of the invention. In order to limit the description to that required to understand the invention, U.S. Pat. No. 4,325,224, which is assigned to the same assignee as the present application is hereby incorporated into the specification of the present application by reference.

Transport refrigeration system 14 may be mounted on or adjacent to an insulated wall 16 of a truck, trailer, or container, for example, with wall 16 having outer and inner surfaces 18 and 19. The inner surface 19 is adjacent to an area 20 to be temperature controlled, which area is also called the served space. Transport refrigeration system 14 has a closed fluid refrigerant circuit which includes a compressor 28 driven by a prime mover, such as an internal combustion engine indicated generally by broken outline 30. The discharge ports of compressor 28 are connected to an inlet port of a three-way valve 32 via a discharge service valve 34 and a hot gas conduit or line 36. The functions of the three-way valve 32, which has heating and cooling positions for initiating heating and cooling modes of the system 14, respectively, may be provided by two separate valves, if desired.

In the cooling position of three-way valve 32, one of the output ports of the three-way valve 32 is connected to the inlet side of a condenser coil 38. The outlet side of the condenser coil 38 is connected to a receiver tank 40 via a one-way condenser check valve CV1 which enables fluid flow only from the outlet side of the condenser coil 38 to the receiver tank 40. An outlet valve 44 on the receiver tank 40 is connected to a heat exchanger 46 via a liquid line 42 which includes a dehydrator 48.

The liquid refrigerant from liquid line 42 continues through a coil in the heat exchanger 46 to a maximum operating pressure expansion valve 50. The outlet of expansion valve 50 is connected to the input side of an evaporator coil 52, and the outlet of evaporator coil 52 is connected to a closed accumulator tank 54 by way of heat exchanger 46. Expansion valve 50 is controlled by an expansion valve thermal bulb 56 and an equalizer line 58. As shown in FIG. 1, evaporator coil 52 is located in the served space 20.

Gaseous refrigerant in the accumulator tank 54 is directed to a suction port of compressor 28 via a suction line 60 and a suction line service valve 62. It will be noted that a suction throttling valve is not utilized.

In the heating position of three-way valve 32, a hot gas line 66 extends from a second outlet port of the three-way valve 32 to the inlet side of evaporator coil 52 via a defrost pan heater 68, by-passing the expansion valve 50. A pressurizing tap 67 extends from the hot gas line 66 to the receiver tank 40 via a by-pass check valve 69 and a by-pass service valve 71, to pressurize receiver 40 and force more liquid refrigerant into the system during a heating mode.

Three-way valve 32 is controlled by pressure obtained from the intake side of compressor 28 via a line 70 which includes a normally closed pilot solenoid valve PS. When the solenoid operated valve PS is closed, the three-way valve 32 is spring biased to the cooling position, to direct hot, high pressure gas from the compressor 28 to the condenser coil 38. Condenser coil 38 removes heat from the gas and condenses the gas to a lower pressure liquid. When the evaporator coil 52 requires defrosting, and also when a heating mode is required to hold the set point selected by a thermostat, the pilot solenoid valve PS is opened and the compressor pressure operates the three-way valve 32 to its heating position.

The maximum operating pressure expansion valve 50 limits the power required to drive the compressor 28 during a cooling mode. Power required to drive compressor 28 is limited during a heating mode by a hot gas restrictor 72 in the hot gas line 66 which connects three-way valve 32 to the defrost pan heater 68, and by connecting a by-pass line 74 from hot gas line 36 to the inlet side of condenser 38. By-pass line 74 includes a normally closed solenoid operated valve DPV, which is enabled only during a heating mode, and which is operated by a dump valve pressure switch 76 mounted in the compressor discharge manifold. Dump valve pressure switch 76, for example, may be selected to close its contacts at 300 psig, and to reset at 200 psig.

Two additional normally open pressure switches 78 and 80 are also disposed to monitor the compressor discharge pressure for the purpose of enabling the operation of first and second unloader solenoids US1 and US2 (FIG. 2) only if the compressor discharge pressure exceeds predetermined values at the time compressor cylinders are selected for unloading by energization of their associated unloading solenoid.

Figure 2:
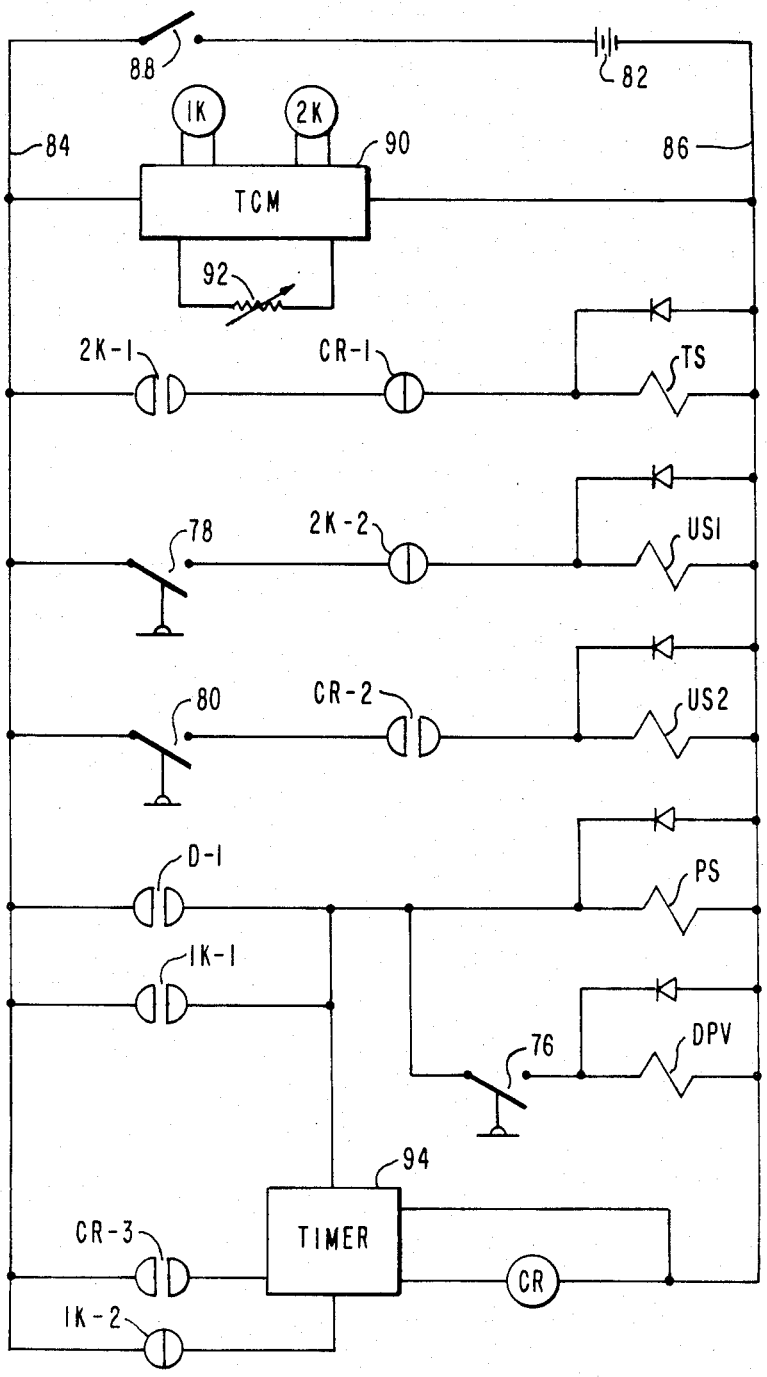
FIG. 2 is a schematic electrical diagram illustrating how various solenoids, valves, relays, and pressure switches are connected and operated according to the method of the invention.

FIG. 2 is an electrical schematic diagram of transport refrigeration system 14, illustrating only those elements of the refrigeration control which are necessary to an understanding of the invention. A battery 82 is connected to energize a pair of conductors 84 and 86 via a switch 88. A thermostat 90, also called a temperature control module TCM, is connected between conductors 84 and 86. Thermostat 90 includes a temperature sensor 92 which is disposed in a temperature controlled area, i.e., in the served space 20. Thermostat 90 also includes a heat relay 1KH and a speed relay 2KH which operate at predetermined temperatures relative to a temperature set point which is usually manually set to select the desired temperature of the served space.

Figure 3:
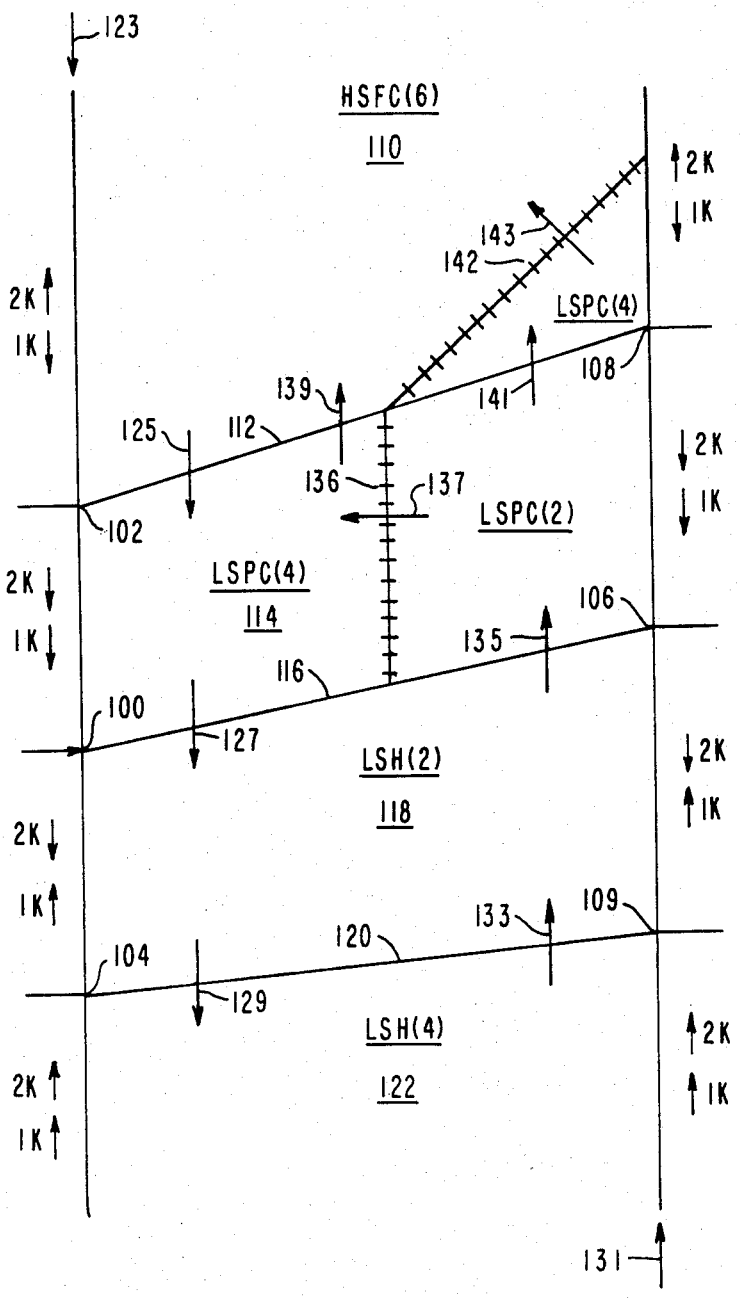
FIG. 3 is a diagram which illustrates the various operating modes of the new and improved method, with the modes for falling and rising temperatures of the served space being generally shown along the left and right hand sides, respectively, of the diagram.

FIG. 3 is a diagram which illustrates the sequence in which relays 1K and 2K, as well as a control relay CR and certain solenoids, operate for falling and rising temperatures in the served space 20. The sequence for a falling temperature descends along the left hand side of the diagram, and the sequence for a rising temperature ascends along the right hand side of the diagram. An upwardly pointing arrow indicates the associated relay is energized, and a downwardly pointing arrow indicates the associated relay is de-energized.

The heat relay 1K selects a cooling mode when it is de-energized and a heating mode when it is energized. The heat relay 1K includes a normally open contact 1K-1 and a normally closed contact 1K-2.

The speed relay 2K, when energized, normally selects "high speed" of the prime mover 30, such as 2200 RPM, and "low speed" when de-energized, such as 1400 RPM, but the effect of the speed relay 2K picking up and dropping out has been modified by the teachings of the present invention, as will be hereinafter described. The speed relay has a normally open contact 2K-1 and a normally closed contact 2K-2.

Control relay CR includes a normally closed contact CR-1 and normally open contacts CR-2 and CR-3. Control relay CR is operated through a timer 94, such as Syracuse Electronic Corporation's model FC119. Closure of normally open contact 1K-1 of the heat relay 1K, or closure of a normally open contact D-1 from a defrost relay (not shown), will energize control relay CR and enable timer 94. Normally open contact CR-3 of control relay CR is connected to close and seal-in relay CR via a closed internal contact in timer 94 which remains closed until the timing period of timer 94 is activated and times out. The closed internal contact of timer 94 then opens to drop relay CR. The normally closed contact 1K-2 of the heat relay is connected to timer 94 such that closure of contact 1K-2, after timer 94 has been enabled by closure of contact 1K-1, will activate timer 94. Thus, picking up of the heat relay 1K to initiate switching the system 14 from the cooling mode to the heating mode enables timer 94 by closing contact 1K-1 and opening contact 1K-2; and dropping out of heat relay 1K, which initiates switching of the system 14 back to the cooling mode, activates the timing period of timer 94 by opening contact 1K-1 and by closing contact 1K-2. Closing of contact 1K-1 also picks up control relay CR, which then remains energized until timer 94 has been activated and has timed out.

A throttle solenoid TS is connected between conductors 84 and 86 via the serially connected normally open contact 2K-1 of the speed relay 2K and the normally closed contact CR-1 of the control relay CR. When throttle solenoid TS is energized it advances the throttle of the prime mover 30 to the high speed position, and when solenoid TS is de-energized, it returns the throttle to the low speed position.

The pilot solenoid PS is connected between conductors 84 and 86 via the parallel connected normally open contact D-1 of the defrost relay, which relay picks up to initiate a defrost operation of the evaporator coil 52, and the normally open contact 1K-1 of the heat relay 1K. When the pilot solenoid PS is de-energized it selects the cooling position of the three-way valve 32, and when it is energized it selects the heating position of the three-way valve.

The solenoid operated dump valve DPV shown in FIG. 1 is connected between conductors 84 and 86 via pressure switch 76 and the same parallel connected contacts D-1 and 1K-1 which connect the pilot solenoid PS to conductor 84. Thus, dump valve DPV is only enabled during a heating or defrost cycle, and it will only be energized during such a heating or defrost cycle when pressure switch 76 closes upon reaching a predetermined compressor head pressure.

The first unloader solenoid US1 is connected between conductors 84 and 86 via normally closed contact 2K-2 of the speed relay 2K, and pressure switch 78. Thus, unloader solenoid US1 can only be energized to unload two compressor cylinders when the compressor head pressure is exceeding the pressure which will close pressure switch 78, and the speed relay 2K is de-energized.

The second unloader solenoid US2 is connected between conductors 84 and 86 via normally open contact CR-2 of the control relay CR, and pressure switch 80. Thus, unloader solenoid US2 can only be energized to unload two other compressor cylinders when the compressor head pressure is exceeding the pressure which will close pressure switch 80, and the control relay CR is energized.

The operation of transport refrigeration system 14 will now be described using the diagram set forth in FIG. 3, with reference to the electrical schematic diagram shown in FIG. 2. The desired temperature of the served space 20 is initially selected, with this temperature, called the "set point", being indicated at 100 in FIG. 3. There are two other temperatures which are detected by the thermostat 90 during a falling temperature of the served space 20, with the first being a temperature a few degrees above set point, indicated at 102, and the second being a temperature a few degrees below set point, indicated at 104. To prevent needless cycling once a monitored temperature point is reached in a given temperature direction, hysteresis is provided by thermostat 90. Thus, the set point for a rising temperature of the served space is about one degree higher than temperature 100, indicated at 106, and the temperatures above and below the set point which are monitored for a rising temperature of the served space are one to two degrees higher than temperatures 102 and 104, indicated at 108 and 109, respectively. While the monitored temperatures are slightly different for falling and rising temperatures of the served space, this difference will be ignored when referring to temperature ranges, as it will be convenient to refer to four temperature ranges. The temperatures from ambient to the monitored temperature 102 will be referred to as the first temperature range 110, i.e., the temperatures above line 112. The temperatures from temperature 102 to the set point temperature 100 will be referred to as the second temperature range 114, i.e., the temperatures between lines 112 and 116. The temperatures from set point temperature 100 to the monitored temperature 104 will be referred to as the third temperature range 118, i.e., the temperatures between lines 116 and 120. The temperatures below line 120 will be referred to as the fourth temperature range 122.

Upon initial start-up, it will be assumed that the temperature of the served space will be in the first temperature range 110, and rapid temperature pull-down is thus desired. Accordingly, in an initial step of the method, indicated by arrow 123, the system will operate at high speed with maximum cooling capacity, i.e., all six cylinders will be loaded. Thus, the high speed relay 2K will be energized by thermostat 90, calling for high speed operation. The heat relay 1K will be de-energized by thermostat 90, calling for the cooling mode. The pilot solenoid PS will be de-energized, to allow valve 32 to be biased to its cooling mode position. The control relay CR will be de-energized during a cooling mode, and thus the throttle solenoid TS will be energized through the closed contacts 2K-1 and CR-1, advancing the throttle of the prime mover to the high speed position. The first unloader solenoid US1 will be de-energized because of the open contact 2K-2, and the second unloader solenoid US2 will be de-energized because of the open contact CR-2, and thus all six cylinders of compressor 28 will be loaded. The dump valve solenoid DPV will be disabled during a cooling mode due to the open contact 1K-1 of the heat relay and the open contact D-1 of the defrost relay. The transport refrigeration system is thus working at high speed with full cooling capacity, which will be referred to as HSFC(6), with the number in parenthesis indicating the number of loaded compressor cylinders.

With maximum cooling capacity, the temperature of the served space 20 will be rapidly pulled down to temperature 102. When the temperature crosses into the second temperature zone 114 the next step of the method, indicated by arrow 125, is initiated. In this step the high speed relay 2K drops, contacts 2K-1 opens to drop the throttle solenoid TS and move the throttle of the prime mover 30 to the low speed position, and contact 2K-2 closes to energize the first unloader solenoid US1. Solenoid US1, when energized, unloads two cylinders of compressor 28. Thus, the system will be operating at low speed with partial cooling, referred to as LSPC(4).

If the temperature of the served space 20 continues to drop upon reaching the set point 100, i.e., into the third temperature range 118, the next step of the method, indicated by arrow 127, is initiated. In this step, the temperature control module 90 will cause the heat relay 1K to pick up, contact 1K-1 will close, and pilot solenoid PS will energize, shifting valve 32 to its heating mode position. The closing of contact 1K-1 also enables the dump solenoid valve DPV to be responsive to compressor head pressure via pressure switch 76. Should the compressor head pressure reach the pressure which closes switch 76, solenoid valve DPV will open to reduce head pressure by dumping part of the hot gas output of compressor 28 into condenser 38. The protection provided by dump valve DPV, along with the hot gas restrictor 72 in the hot gas line 66, eliminates the need for a costly suction throttle valve in suction line 60, significantly improving cooling capacity by eliminating the pressure drop such a valve would have in a six cylinder compressor refrigeration system. Relay CR will also be energized via contact 1K-1, and timer 94 will be enabled such that when the now open contact 1K-2 closes, the timing period of timer 94 will be initiated.

When control relay CR picks up, it opens its contact CR-1 to block out high speed operation during a heating mode, which includes both a heating cycle to maintain set point, and a defrost cycle. Contact CR-2 closes to pick up the second unloader solenoid US2, dropping the total number of loaded cylinders to two. Contact CR-3 closes to seal in the control relay CR until timer 94 is activated and its timing period has timed out. Thus, the system will now be operating low speed heat with two cylinders loaded, or LSH(2).

If the temperature of the served space 20 continues to fall such that it crosses line 120 into the fourth temperature zone 122, another step of the method, indicated by arrow 129, is initiated. In this step, thermostat 90 will cause the high speed relay 2K to pick up. According to the teachings of the invention, the high speed relay, instead of changing the speed of prime mover 30, is now used to control system heating capacity by loading two more compressor cylinders, while maintaining low speed operation. Contact 2K-1 closes without circuit effect, as contact CR-1 of the control relay is open, thus preventing energization of the throttle solenoid TS. Contact 2K-2 opens to drop unloader solenoid US1, loading two more cylinders. Thus, operation in the fourth temperature zone 122 will be low speed heat with four cylinders loaded, or LSH(4). This will be adequate heating capacity for the most severe ambient temperatures, and the temperature will now start to rise.

To describe the operation of the invention with a rising temperature in the served space 20, it will be assumed that the temperature is in the fourth temperature range 122, indicated by arrow 131, and the system is operating LSH(4). Thus, speed relay 2K will be energized, heat relay 1K will be energized, the first unloader solenoid US1 will be de-energized, the second unloader solenoid US2 will be energized, pilot solenoid PS will be energized, throttle solenoid TS will be de-energized, control relay CR will be energized, timer 94 will be enabled but not activated, and the solenoid operated dump valve DPV will be enabled for operation in response to pressure switch 76.

When the temperature of the served space 20 rises into the third temperature range 118, another step of the method, indicated by arrow 133, is initiated. In this step, the speed relay 2K will drop, energizing the first unloader solenoid US1 to unload two cylinders. Thus, the operation will be low speed heat with two cylinders loaded, or LSH(2).

A continued rise in the temperature of the served space 20, such that it crosses into the second temperature zone 114, initiates another step of the method, indicated by arrow 135. This step switches the system from a heating to a cooling mode, but at least initially maintains two cylinder compressor operation to determine if that capacity of cooling will return the system to set point. In general, the method at this point responds to what the temperature of the served space 20 does relative to two trigger events, i.e., relative to time, as established by the timing period; relative to temperature 108; and relative to the set point temperature 106.

More specifically, the heat relay 1K will drop when range 114 is entered, opening contact 1K-1 to drop pilot solenoid PS and switch system operation from the heating mode to the cooling mode. Contact 1K-2 closes to activate the previously enabled timer 94. Timer 94 now starts a predetermined timing period, such as eight minutes, with control relay CR remaining in its energized state via contact CR-3 and an internal contact of timer 94. The opening of contact 1K-1 also makes the dump valve DPV non-responsive to the pressure switch 76. If two cylinder cooling capacity is adequate, driving the temperature of the served space 20 back into temperature range 118 before the timing period expires, timer 94 will be reset, and the system may cycle about set point in low speed, two cylinder operation, merely changing back and forth between the heating and cooling modes.

If two cylinder cooling capacity is not adequate to return the system to the third temperature range 118, but sufficient to maintain the temperature in the second temperature range 114, the timing period will expire. Timer expiration in the second temperature range 114 is indicated by vertical line 136, with timer expiration within temperature range 114 being a trigger event which initiates the next step, indicated by arrow 137. In this step, the system operation is changed from LSPC(2) to LSPC(4). When time expires, control relay CR drops, contact CR-1 closes to enable high speed operation, contact CR-2 opens to drop the second unloader solenoid US-2 and activate two more compressor cylinders, and the seal contact CR-3 opens. Thus, the operation is now LSPC(4).

If four cylinder cooling capacity is sufficient to return the temperature of space 20 to the third temperature range 118, the system will maintain set point by cycling through modes LSH(2), LSPC(2), and LSPC(4). If the LSPC(4) cooling capacity is not sufficient, the temperature will cross line 112 into the first temperature range 110. This is another trigger event, initiating a step of the method which is indicated by arrow 139. In this step, the speed relay 2K picks up. As hereinbefore explained, this will energize the throttle solenoid TS to initiate high speed opeation, and unloader solenoid US1 will drop to load the last two compressor cylinders, to provide the maximum cooling mode HSFC(6).

Return now to arrow 135, i.e., the condition where the rising temperature has just crossed line 116 into the second temperature range 114. If cooling capacity is not sufficient in the LSPC(2) mode and the temperature rises past line 112 into the first temperature range 110 before the timer 94 expires, this is a trigger event which initiates another step, indicated by arrow 141. This step, instead of initiating the HSFC(6) mode, initiates the LSPC(4) mode. The expiration time of timer 94 is indicated by line 142 in the first temperature range 110. When timer 94 is active, control relay CR will be energized, preventing the throttle solenoid from being energized when the high speed relay 2K picks up, and contact CR-2 will maintain energization of unloader solenoid US2. Thus, contact 2K-2 will open to drop unloader solenoid US1, loading two additional cylinders of compressor 28. Operation will change from LSPC(2) to LSPC(4). If four cylinder cooling capacity is sufficient to drop the temperature below line 112 before the timer 94 times out, the speed relay 2K will drop and the system will return to LSPC(2). If four cylinder cooling capacity is not sufficient, timer 94 will expire, which is another trigger event, triggering the step indicated by arrow 143 in which the system changes to HSFC(6). When timer 94 expires, control relay CR will drop to energize the throttle solenoid TS and initiate high speed operation, and unloader solenoid US2 will drop to bring the number of loaded cylinders to six.

If while timer 94 is active the cooling capacity is sufficient at LSPC(4) but insufficient at LSPC(2), the system may cycle back and forth across line 112 until timer 94 expires. If the system happens to be in LSPC(2) when the timer expires it will follow arrow 137 from LSPC(2) to LSPC(4). If the system happens to be in LSPC(4) when timer 94 expires, the system will follow arrow 143 to HSFC(6).

In summary, there has been disclosed a new and improved method of operating a transport refrigeration system with a six cylinder compressor, which provides the advantages of: (a) eliminating the need for a suction throttling valve, which thus eliminates the associated pressure drop during the cooling mode to provide maximum cooling capacity form a given refrigeration system, (b) providing a maximum operating pressure expansion valve to limit compressor horsepower in the cooling mode, (c) protecting against overload of the prime mover while in a heating mode by providing a restriction 72 in the hot gas line 66 and a compressor head responsive solenoid operated dump valve DPV for dumping hot gas from the compressor into the condenser should the compressor head pressure reach a predetermined value, (d) operating the prime mover at high speed and the compressor with six loaded cylinders only during rapid temperature pull-down, (e) using cylinder unloaders to control heating and cooling capacity instead of shifting compressor speeds in all other heating and cooling modes, and (f) providing several alternative cooling modes when the temperature of the area to be served rises above the set point, to operate with the fewest loaded compressor cylinders which will return the temperature to set point, while minimizing system shifts into HSFC(6).

We claims:

1. A method of operating a transport refrigeration system having a six cylinder compressor, an evaporator, a condenser, and a prime mover operable in a selected one of high and low speeds, to control the temperature of a served space via cooling and hot gas heating modes above and below a predetermined set point, respectively, with the refrigeration system further including control means which changes its operating state at first and second predetermined temperatures, above and below the set point, respectively, to define a first temperature range above the first predetermined temperature, a second temperature range between the first predetermined temperature and the set point, a third temperature range from the set point to the second predetermined temperature, and a fourth temperature range below the second predetermined temperature, comprising the steps of:

operating the system in a two cylinder low speed heating mode when the temperature of the served space is in the third temperature range, switching from the two cylinder low speed heating mode to a two cylinder low speed cooling mode when the temperature of the served space changes from the third temperature range to the second temperature range, activating a predetermined timing period when the temperature of the served space changes from the third temperature range of the second temperature range, loading two additional cylinders of the compressor to operate in a four cylinder low speed cooling mode in response to either of the following two trigger conditions occurring before the temperature of the served space again enters the third temperature range: (a) the timing period expiring or (b) the temperature of the served space changing from the second temperature range to the first temperature range, and switching from the four cylinder low speed cooling mode to a six cylinder high speed cooling mode in response to the remaining trigger condition occurring before the temperature of the served space again enters the third temperature range.

2. The method of claim 1 including the step of switching from the two cylinder low speed cooling mode to the two cylinder low speed heating mode when the temperature of the served space changes from the second temperature zone to the third temperature zone before the occurrence of either trigger condition.

3. The method of claim 1 including the step of enabling the activating step when the temperature of the served space changes from the second temperature range to the third temperature range.

4. The method of claim 1 including the steps of:

operating the system in a six cylinder high speed cooling mode upon initial start-up when the temperature of the served space is the first range, switching from the six cylinder high speed cooling mode to the four cylinder low speed cooling mode when the temperature of the served space changes from the first temperature range to the second temperature range, switching from the four cylinder low speed cooling mode to the two cylinder low speed heating mode when the temperature of the served space changes from the second temperature range to the third temperature range, and switching from the two cylinder low speed heating mode to a four cylinder low speed heating mode when the temperature of the served space changes from the third temperature range to the fourth temperature range.

5. The method of claim 4 including the step of enabling the activating step when the temperature of the served space changes from the second temperature range to the third temperature range.

6. The method of claim 4 including the steps of:

monitoring a predetermined pressure of the compressor, detecting when the predetermined pressure exceeds a predetermined magnitude, and dumping the output of the compressor into the condenser in response to the detection of the predetermined magnitude while the transport refrigeration system is in a heating mode.

7. The method of claim 6 including the step of enabling the dumping step when the temperature of the served space changes from the second temperature range to the third temperature range, and disabling the dumping step when the temperature of the served space changes from the third temperature range to the second temperature range.

* * * * *